US005922081A

United States Patent [19]

Seewig et al.

[11] Patent Number: 5,922,081

[45] Date of Patent: Jul. 13, 1999

[54] EXCITATION SYSTEM FOR AN ANTENNA WITH A PARABOLIC REFLECTOR AND A DIELECTRIC RADIATOR

[75] Inventors: Udo Seewig, Langenhagen; Gerd Bohnet, Isernhagen, both of Germany

[73] Assignee: Alcatel, France

[21] Appl. No.: 08/886,803

[22] Filed: Jul. 2, 1997

[30] Foreign Application Priority Data

Jul. 3, 1996 [DE] Germany ..... 196 26 655

[51] Int. Cl.[6] ..... H01Q 13/00

[52] U.S. Cl. ..... 743/485; 343/772; 343/781 R

[58] Field of Search ..... 343/785, 782, 343/781, 781 R, 783, 786, 772

[56] References Cited

U.S. PATENT DOCUMENTS

| | | | |
|---|---|---|---|
| 2,556,087 | 6/1951 | Iams | 343/780 |
| 3,530,480 | 9/1970 | Rongved et al. | 343/781 |
| 4,673,947 | 6/1987 | Newham | 343/781 CA |

FOREIGN PATENT DOCUMENTS

| | | |
|---|---|---|
| OS 2240893 | 8/1972 | Germany . |
| 29 28 187 A1 | 9/1979 | Germany . |
| 973583 | 10/1964 | United Kingdom . |

OTHER PUBLICATIONS

Meinke, Gundlach: Taschenbuch der Hockfrequenztechnik, Grundlagen, Komponenten, Systeme, Springer Verlag, Berlin, 1992.

JP 63–33907 A., Patent Abstracts of Japan, E–632 Jul. 12, 1988, vol. 12/No. 246.

Erukhimovitch et al., International Conference on Antennas and Propogation, London, England, 28–30 Nov. 1978, pp. 205–206.

Johnson, Richard C., Antenna Engineering Handbook, 3rd ed., McGraw–Hill, pp. 17–6–7, 1993.

*Primary Examiner*—Don Wong
*Assistant Examiner*—Jennifer H. Malos
*Attorney, Agent, or Firm*—Ware, Fressola, Van der Sluys & Adolphson LLP

[57] ABSTRACT

An excitation system is indicated for an antenna with a parabolic reflector (1) and a dielectric radiator (3) which is attached to the end of a hollow conductor used to guide electromagnetic waves, and is located in the center of the reflector (1) and has a metallized end face designed as a subreflector. The reflector (1) is designed as a rectangular strip forming a sector antenna which has a parabolic curve in the direction of its long axis (A). The end face of the radiator (3) has four partial faces (8, 9, 10, 11) which form pairs and are arranged with respect to the central axis of the hollow waveguide (2) so that each pair of partial faces extends approximately at a right angle to the other pair of partial faces, the partial faces of each pair being of equal size. The two partial faces (8, 9) extending in the direction of the long axis of reflector (1) are large in relation to the two partial faces (10, 11) extending crosswise thereto.

12 Claims, 1 Drawing Sheet

EXCITATION SYSTEM FOR AN ANTENNA WITH A PARABOLIC REFLECTOR AND A DIELECTRIC RADIATOR

BACKGROUND OF THE INVENTION

1. Technical Field

The invention concerns an excitation system for an antenna with a parabolic reflector and a dielectric radiator which is attached to the end of a hollow conductor used to guide electromagnetic waves, and is located in the center of the reflector and has a metallized end face designed as a subreflector (DE 29 38 187 A1).

2. Description of the Prior Art

Because of the subreflector, such antennas are also called "Cassegrain" antennas. They are used for radio, television, telephone and data transmissions for example. Antennas in accordance with the above mentioned DE 29 38 187 A1 are relatively simple to construct since the radiator with subreflector used as the "exciter" is supported by the hollow conductor which is attached to the center of the reflector. To provide the correct dimensions to the circular radiator and reflector, essentially only the relative dielectric permittivity $\epsilon_1$ of the dielectric material being used must be taken into consideration. The excitation system known from DE 29 38 187 A1 can be used for parabolic antennas with a circular reflector which is formed as a rotated paraboloid.

SUMMARY OF THE INVENTION

It is an object of the present invention to develop the excitation system described above, so that it can also be used for sector antennas whose reflector is not circular. The invention fulfills this object in that:

- the reflector is designed as a rectangular strip which curves parabolically in the direction of its long axis to form a sector antenna,
- the end face of the radiator has four partial faces which form pairs with the partial faces of each pair being of equal size and are arranged with respect to the central axis of the hollow conductor so that the partial faces of each pair extend at approximately right angles to each other, and
- the partial faces of one pair extending in the direction of the long axis of the reflector and are larger than the two partial faces of the other pair which extend crosswise thereto.

With this structure, it is possible to simply equip a sector antenna with a dielectric radiator supported by a central hollow conducter, which is an essentially known and advantageous excitation system. Costly special structures for the excitation system, such as are described for example in the DE-book "Pocket Book of High-Frequency Technology" by Meinke/Gundlach, 5th. edition, Springer publishers, 1992, pages N51 and N52, can thereby be avoided. The complete illumination of the reflector at maximum gain is achieved by a geometric construction of the radiator that deviates from the geometric construction and arrangement of the reflector. The end face used as subreflector is made asymmetrical by the differently sized but equal pairs of partial faces in the direction of rotation. Thus the geometrical congruence of reflector and radiator known from DE 29 38 187 A1 is not used with this excitation system.

The invention will be fully understood when reference is made to the following detailed description taken in conjunction with the accompanying drawing.

DETAILED DESCRIPTION OF THE INVENTION

Figure 1:
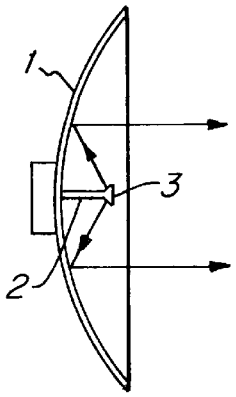
FIG. 1 is a schematic lateral view of a sector antenna with an excitation system according to the invention.
Figure 2:
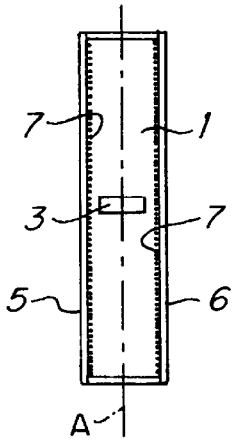
FIG. 2 is a front view of the sector antenna.

The sector antenna illustrated in FIGS. 1 and 2 has a reflector 1 designed as a rectangular strip. It curves parabolically in the direction of its long axis A. An excitation system comprising a hollow conductor 2 and a dielectric radiator 3 is arranged in the center of the reflector 1. The radiator 3 has a metallized end face 4 (FIG. 3) at its free end, which is used as a subreflector. Electromagnetic waves guided via the hollow conductor or waveguide 2 are thereby deflected to the reflector 1 along the arrows in FIG. 1 and are radiated by same in the selected sector. The opposite path is used for receiving waves. Such sector antennas are used in mobile radio for example to illuminate a predetermined sector.

The reflector 1 can be closed off by two laterally arranged walls 5 and 6, which run parallel to the axis of hollow conductor 2 and extend to both ends of reflector 1. They are used to attenuate the secondary lobe of the sector antenna. An absorbing material 7 can be placed on the insides of the walls 5 and 6 to further improve the attenuation of the secondary lobe.

As already mentioned, the excitation system comprises the hollow conductor 2 and the dielectric radiator 3 supported by same. To that end the dielectric body of the radiator 3 has an attachment part 3*a* which protrudes into the hollow conductor 2. The end face 4 of radiator 3 drawn with bold lines in FIG. 3 is shaped to achieve the radiation characteristics described above.

In the present case, the radiator 3 has four partial faces forming equal pairs and their opposing faces are arranged with respect to the central axis of the hollow conductor 2. A radiator 3 with a rectangular end face can be seen in FIG. 4. The end face 4 is subdivided into four partial faces 8 and 9 on one axis as well as 10 and 11 on the other axis, which form equal pairs of the same size that oppose each other with respect to the axis of hollow conductor or waveguide 2. At least a portion of each of the partial faces 8 and 9 essentially extends at right angles in relation to the long axis A of reflector 1 and the sector antenna, respectively. The partial faces 10 and 11 of radiator 3 are essentially arranged at right angles to the partial faces 8 and 9. In this way they delimit the dielectric body of radiator 3 on two sides, which are approximately at right angles to the sides of the dielectric body in which the partial faces 8 and 9 are located.

Figure 3:
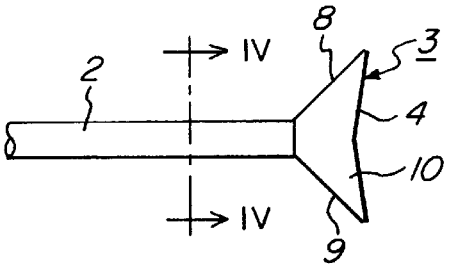
FIG. 3 is an enlarged view of the excitation system.
Figure 4:
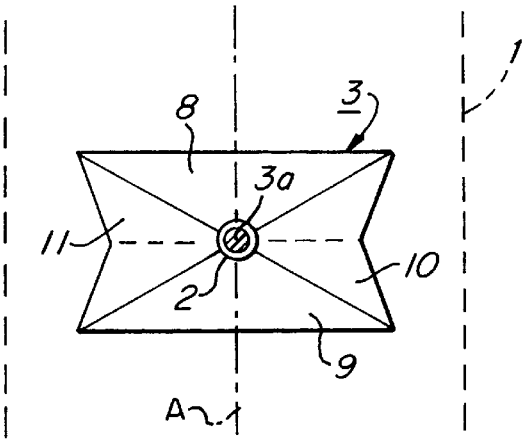
FIG. 4 is a cut through FIG. 3 along line IV—IV.

As already mentioned, the partial faces 8 and 9 of the configuration of radiator 3 according to FIGS. 3 and 4 extend mostly at right angles to the long axis A of the sector antenna. In addition, its surfaces are large in relation to the surfaces of the other two partial faces 10 and 11. This causes the radiation and reception of electromagnetic waves to occur mostly in the direction of the long axis A of the reflector antenna.

Figure 5:
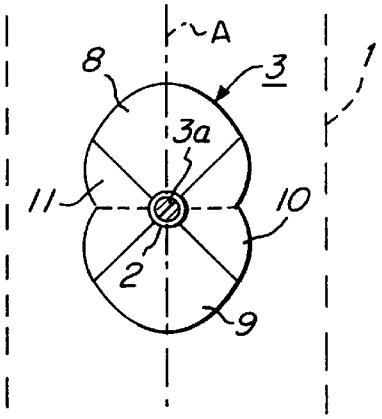
FIG. 5 is a configuration of the radiator which is modified with respect to FIG. 4.

According to FIG. 5, the end face 4 of radiator 3 can also be oval. The shape of the partial faces 8 and 9 or 10 and 11 changes accordingly. This applies to all geometrical configurations of the end face 4. In all instances, the partial faces 8 and 9 are always large in relation to the partial faces 10 and 11.

Figure 6:
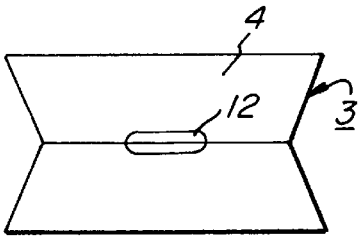
FIG. 6 is a top view of a radiator according to FIG. 3, looking in a direction opposite that of FIG. 4.

To improve the reflection behavior of the excitation system, a depression 12 which is symmetrical with the axis of the hollow conductor 2 can be maded in the center of the end face 4 of the dielectric radiator 3 before the metallization. In that case, a metal layer is also produced in the depression 12 during metallization. Such a depression 12 being symmetrical with the axis of the hollow conductor 2 can be seen in FIG. 6 for example.

The preferred embodiments described above admirably achieve the objects of the invention. However, it will be appreciated that departures can be made by those skilled in the art without departing from the spirit and scope of the invention which is limited only by the following claims.

What is claimed:

1. An excitation system for an antenna comprising:

(a) a reflector defining a sector antenna including a rectangular strip formed into a parabolic curve along its long axis and thereby defining two parabolic lengthwise edges and two ends;

(b) an electromagnetic waveguide used to guide electromagnetic waves and placed in a center of the reflector, the electromagnetic waveguide having a central axis; and (c) a dielectric radiator with a metallized end face designed as a subreflector placed at an end of the waveguide, the end face having two pairs of partial faces, the partial faces of each pair being substantially equally sized and being arranged with respect to the central axis of the electromagnetic waveguide so that each pair of partial faces is approximately at right angles to the other pair of partial faces, and the partial faces of one pair extending in a direction of the long axis of the reflector are larger in comparison to the partial faces of the other pair, which extend crosswise thereto.

2. An excitation system as claimed in claim 1, wherein (a) the end face of the radiator is essentially rectangular; and (b) at least a portion of each of the partial faces extending in the direction of the long axis extends essentially at right angles to the long axis.

3. An excitation system as claimed in claim 2, further including a depression centrally located in the end face of radiator and symmetrical with the central axis of the electromagnetic waveguide.

4. An excitation system as claimed in claim 2, further including a wall on each parabolic lengthwise edge of the rectangular strip, each wall being parallel to the central axis of the electromagnetic waveguide and closing off the reflector laterally up to the two ends of the rectangular strip.

5. An excitation system as claimed in claim 4, further including electromagnetic-radiation-absorbing material on an interior surface of each wall.

6. An excitation system as claimed in claim 1, further including a wall on each parabolic lengthwise edge of the rectangular strip, each wall being parallel to the central axis of electromagnetic waveguide and closing off the reflector laterally up to the two ends of the rectangular strip.

7. An excitation system as claimed in claim 6, further including electromagnetic-radiation-absorbing material on an interior surface of each wall.

8. An excitation system as claimed in claim 1, wherein the end face of the radiator is essentially oval.

9. An excitation system as claimed in claim 8, further including a depression centrally located in the end face of radiator and symmetrical with the central axis of the hollow conductor.

10. An excitation system as claimed in claim 9, further including a wall on each parabolic lengthwise edge of the rectangular strip, each wall being parallel to the central axis of electromagnetic waveguide and closing off the reflector laterally up to the two ends of the rectangular strip.

11. An excitation system as claimed in claim 10, further including electromagnetic-radiation-absorbing material on an interior surface of each wall.

12. An excitation system for an antenna comprising:

(a) a reflector defining a sector antenna including a rectangular strip formed into a parabolic curve along its long axis and thereby defining two parabolic lengthwise edges and two ends;

(b) an electromagnetic waveguide used to guide electromagnetic waves and placed in a center of the reflector, the electromagnetic waveguide having a central axis; and (c) a dielectric radiator with a metallized end face designed as a subreflector placed at an end of the waveguide, the end face having two pairs of partial faces, the partial faces of each pair being substantially equally sized and being arranged with respect to the central axis of the electromagnetic waveguide so that each pair of partial faces is approximately at right angles to the other pair of partial faces, and the partial faces of one pair extending in a direction of the long axis of the reflector are larger in comparison to the partial faces of the other pair, which extend crosswise thereto, further including a depression centrally located in the end face of the radiator and symmetrical with the central axis of the electromagnetic waveguide.

* * * * *